United States Patent [19]

Dumont

[11] 4,034,217

[45] July 5, 1977

[54] OPTICAL DEVICE FOR LIGHTING APPARATUS, WITH A PLURALITY OF COMBINED REFLECTORS

[76] Inventor: Roger Louis Dumont, 8, Rue de La Mesange, Thionville, Moselle, France

[22] Filed: June 20, 1975

[21] Appl. No.: 588,681

[30] Foreign Application Priority Data

June 21, 1974 France ..... 74.21695
Apr. 18, 1975 France ..... 75.12254

[52] U.S. Cl. ..... 240/103 R; 240/41.35 R; 240/41.35 C; 240/41.35 F; 240/103 B

[51] Int. Cl.[2] ..... F21V 7/00

[58] Field of Search ..... 240/41.35 R, 41.35 F, 240/103 R, 103 B, 41.35 C

[56] References Cited

UNITED STATES PATENTS

| | | | |
|---|---|---|---|
| 1,757,527 | 5/1930 | Henningsen | 240/103 R |
| 3,233,096 | 2/1966 | Schmitt | 240/103 R |
| 3,829,677 | 8/1974 | DeLiano | 240/103 R |

FOREIGN PATENTS OR APPLICATIONS

| | | | |
|---|---|---|---|
| 703,009 | 2/1931 | France | 240/41.35 C |
| 1,287,031 | 1/1969 | Germany | 240/41.35 R |
| 505,897 | 5/1939 | United Kingdom | 240/103 B |

*Primary Examiner*—Russell E. Adams
*Attorney, Agent, or Firm*—Mason, Fenwick & Lawrence

[57] ABSTRACT

An optical device for lighting including a plurality of combined reflectors to control a beam of light from a lamp and to direct it forward, so no reflected beam passes through the lamp and the light leaving the opening of the reflector forms a parallel beam.

11 Claims, 12 Drawing Figures

FIG. 2a
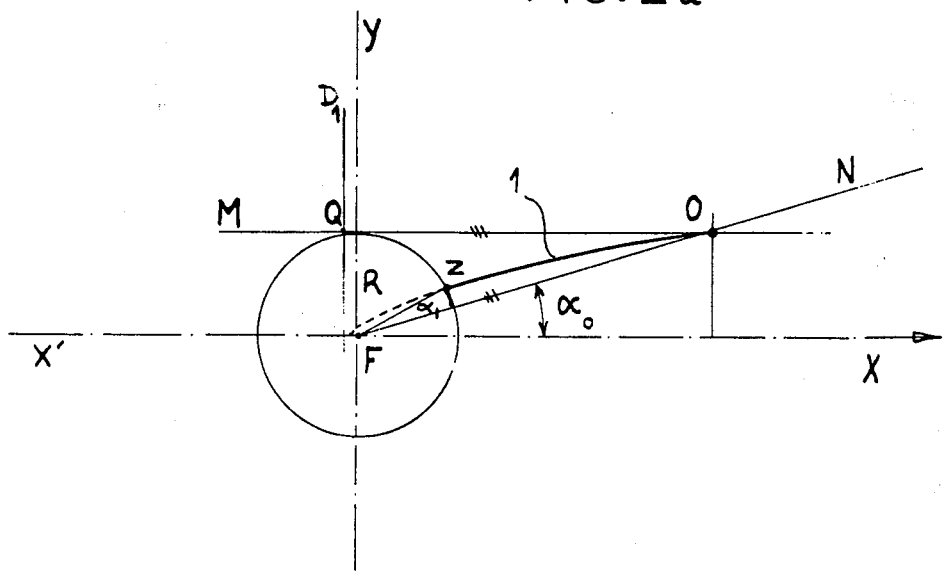
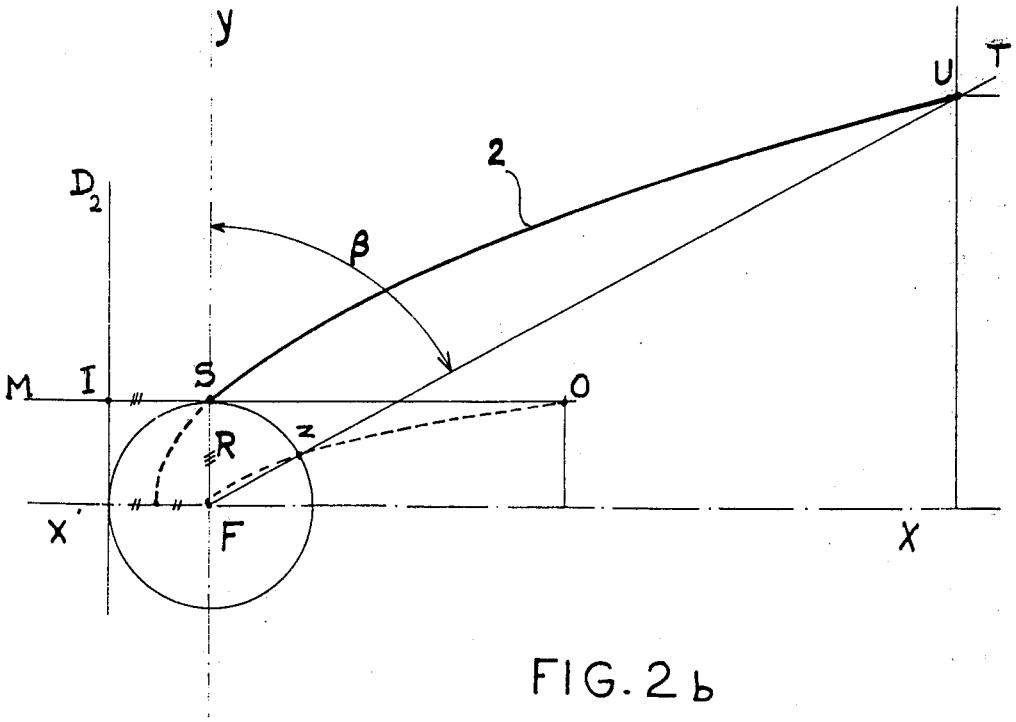
FIG. 2b

OPTICAL DEVICE FOR LIGHTING APPARATUS, WITH A PLURALITY OF COMBINED REFLECTORS

This invention relates to an optical device for lighting apparatus, including a plurality of combined reflectors, intended to control the light from a lamp and to direct it forward so that no reflected beam passes through the lamp again.

In particular, this device produces parallel beams, the intensity of which are constant on the surface of the opening of the device.

In known optics, most of the luminous flow reflected by the active surface of the reflector located behind the lamp is poorly controlled. The luminous beams directed forward pass against the lamp, which results in a decrease in the optical outout and in an increase in the temperature of the lamp which decreases the useful light from the lamp.

Furthermore, a large portion of the light not collected by the reflector is uncontrolled which causes a decrease in useful output and in particular, of that portion which is directable on the axis of the projector. To obtain a suitable beam with present known devices generally necessitates optics of too large a size.

The purpose of the present invention is to remedy the drawbacks of known devices and to provide an optical device which completely controls the light from a lamp and prevents reflected beams from passing back through the lamp again.

Thus, the total output only depends on the reflecting property of the materials used to provide the optical device. The temperature of the lamp depends on the ambient thermic conditions, which principally depend upon the size of the protecting case.

To this end, the invention relates to an optical device which directs the light from a lamp in a forward direction so that no reflected beam passes through the lamp, wherein the reflecting surface is originated by a curve formed by an arc of ellipse (E) having a first focus (F) coinciding with the luminous source (S), a second focus ($F'_1$) constituting a luminous source for the luminous beams reflected by the arc of ellipse, an arc the curve of which is comparable to an arc of parabola ($P_2$) whose axis is parallel with that of the beam, the focus of the curve comparable to a parabola ($P_2$) coinciding with the second focus ($F'_1$) of the ellipse (E).

The present invention is depicted with more details by means of the modes of embodiment diagrammatically shown in the drawings in which:

FIGS. 2A and 2B show a half cross-section view of the lamp and of the auxiliary reflectors shownn in FIG. 1B;

Figure 1A:
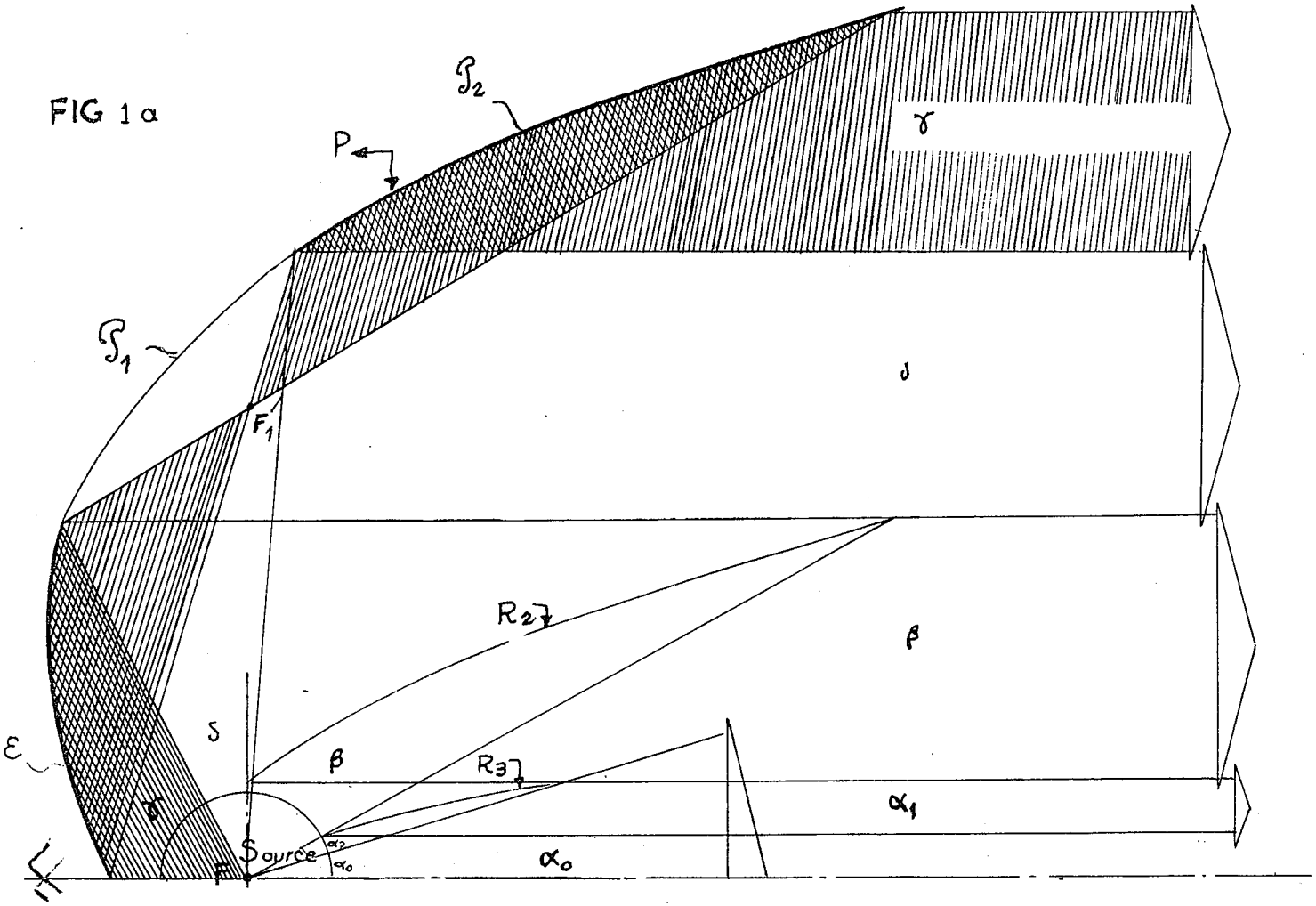
FIG. 1A is a half cross-section view of the optical device with combined reflectors, showing the path followed by the various beams issuing from the lamp.

As shown in FIG. 1A, the optical device consists of a source S and reflectors R1, R2, R3. The rear reflector R1 shows a cross-section view of a directrix curve comprising an ellipse $\epsilon$ followed by a parabola P1, then P2. The reflectors R2 and R3 which receive the beam issued forward by the source consist of two elements of a parabola with focus F.

In regard to the rear reflector R1, the main focus and source of the ellipse $\epsilon$ are F and S respectively. The focus of the parabola P1 is also F. The focus of the parabola P2, whose axis is parallel to the axis of symmetry of the device is the secondary focus F'1 of the ellipse. Thus, the beam issued by the source S within the angle $\gamma$ reflects onto the ellipse $\epsilon$ and converges to the focus F'1 before being reflected by the parabola P2; F'1 also being the focus of the parabola P2, the light issued within the angle $\alpha$ becomes a luminous beam with parallel rays after it reflects onto P2. The beam issued within the angle $\delta$ strikes the parabola P1 direct; after reflecting onto P1, the beam becomes a beam with parallel rays.

The beams originated within the angles $\beta$ and $\alpha_1$ each strike the auxiliary reflectors R2 and R3, thus initiating two beams $\alpha_1$ and $\beta$ with parallel beams. The remaining flow $\alpha_0$ is substantially oriented along the symmetric axis of the device.

Both FIGS. 2A and 2B show the auxiliary reflectors. As shown in FIG. 2a, the auxiliary reflector 1 corresponds, at first study, to tracing of a parabola. The opening of this parabola corresponds to the greatest diameter of the lamp.

When a straight line M is considered, parallel to the optical axis $x$, $x'$, located at a distance equal to the radius E of the lamp, the intersection O of said straight line with the inclined line N issued from the focus F which delimits the useful direct beam, defines the opening plane of the reflector and its distance in relation to the focus as well. These parameters make it possible to draw the parabola.

If $OQ = FO$, the straight line $D_1$, perpendicular to the optical axis and which passes by the point Q, represents the directrix of the parabola and defines its parameter $P_1$.

The point Z delimits the rear opening plane of the reflector.

The portion of parabola thus defined may result in a reflector with plane faces, the faces of which are slightly inclined in relation to each other. Such a change slightly modifies the optical characteristics of the curve under consideration, bu the received beams $\alpha_1$ still remain, after they are reflected, within the limit of the fixed optical opening $2\alpha_0$. In view of the symmetry, the same half-reflector can be drawn at each side of the optical axis.

The reflector 2 (FIG. 2B) also corresponds to a parabola. This parabola collects all the beams included witin the half-angle $\beta$ delimited by a straight line Y perpendicular to the optical axis passing through the focus F and the inclined line T defined by the focus F and point E at the rear edge of the reflector 1. A straight line M, parallel to the optical axis ($x$, $x'$), is located at a distance equal to the radius R of the lamp.

If one assumes $IS = FS = R$ the radius of the lamp, the straight line $D_2$, perpendicular to the optical axis and passing through the point I, represents the directrix of the parabola and defines the parameter P2 thereof with $P_2$ the radius R of the lamp.

The point S delimits the rear opening plane of the reflector.

Point U, the point of intersection of the curve with the inclined line T, delimits the forward opening plane of the reflector.

Thus, the beams originated by the source within the angle $\beta$ will reflect at least one time onto the reflector 2. The portion of this parabola thus defined may result in a reflector with plane faces inclined in relation to each other. The number of said plane faces is greater than that of the reflector 1 (FIG. 2A), in view of the fact that the portion the more prominent at the apex of the parabola is used. This change very slightly modifies the optical characteristics of said "parabola", but the beams collected within the angle $\beta$ still remain, after reflecting, within the fixed limit of the optical opening $2\alpha_0$. It is to be noted that any beam reflected onto said reflector must not be intercepted by the external (or dorsal) face of the reflector 1, and this fact must be taken into account when drawing the small faces.

On the other hand, the whole of the beams issued by the source, excepting that issued within the angle $2\alpha_0$ (which is determined at first sight), must be reflected one time at least onto one of the faces $\epsilon$, $P_1$, $P_2$, (1) or (2). In addition, the location of the point S, which can be located along the circle whose radius is R, (in another point than that located on the vertical of F), determines the end T of the parabola $P_1$, so that no beam issued within the angle $\delta$ directly strikes $P_2$.

Furthermore, the active portion of the source is not always a point and therefore, it is advisable to conceal its direct light with two reflectors 1 and 2, so as to prevent a parasite beam from being originated.

Figure 3:
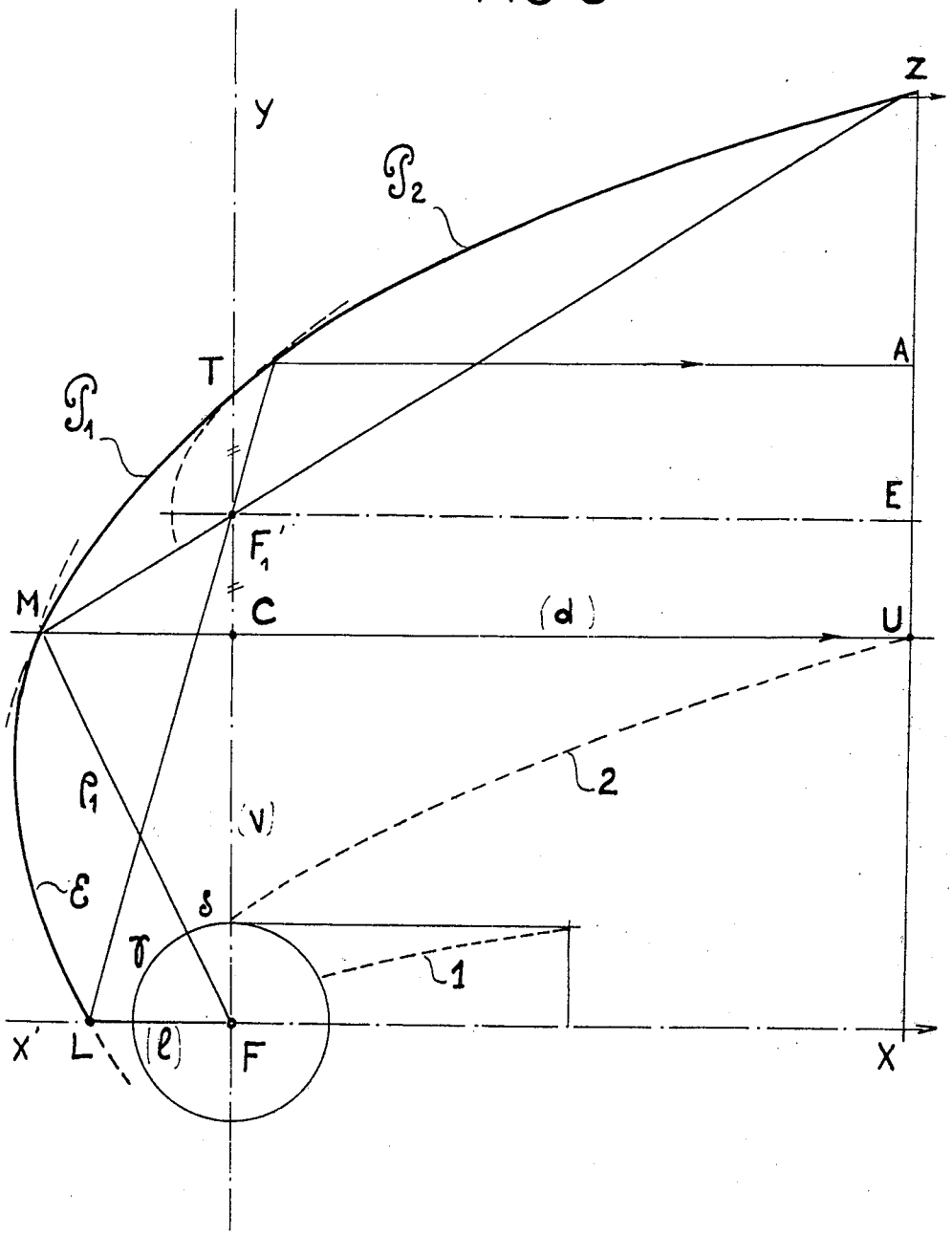
FIG. 3 is a half cross-section view of the rear reflectors.

The rear reflector curve corresponds to three conical components in succession (FIG. 3) which are, starting from $x'$:

1. a portion of ellipse $\epsilon$
2. a parabola $P_1$
3. a parabola $P_2$ whose axis is parallel to $x'x$.

The parabola $P_1$ controls the angle $\delta$ delimited by the half-axis Fy and the radius vectors $\phi_1$ issued from F and ending at the intersection with M, which is the junction point of the parabola $P_1$ with the ellipse whose common focus is F.

The elliptic element plays an intermediate part and carries the focus F (for the angle $\gamma$ included between $\phi_1$ and $Fx'$ at $F'_1$) a secondary focus of the ellipse which also corresponds to that of the parabola $P_2$ located in prolongation of $P_1$ and the junction point T which is located on the vertical Fy.

In order to balance distribution of the flows on the parabolas $P_1$ and $P_2$, the front surfaces UA and AZ must, as far as possible, be proportional to the solid angles of emission $\delta$ and $\gamma$.

In view of these parameters, the lengths $\overline{FC} = V$, $\overline{CU} = d$ are established as well as the nearest point L (on the x axis) of the rear reflector to the lamp $\overline{FL} = l$.

Here is, by way of information, a suitable method to determine the parameters P and p of the parabolas $P_1$ and $P_2$. A compact and balanced assembly is provided if we have:

$$V, d = 2v \leq v/2, CF' = F'_1 T = p$$

it is advisable to predetermine the parameters P and $p$ by taking into account the following relations:

The similitude of the triangles $F_1'$ EZ, $F_1'$ CM allows us to write:

$$\frac{\overline{EZ}}{F_1'C} = \frac{d}{MC} = \frac{\overline{EZ}}{p} \text{ and } \overline{MC} = \frac{dp}{\sqrt{p(2d+p)}}$$

$$+ \sigma^2\gamma = \left(\frac{v}{MC}\right)^2 = \frac{v^2(2d+p)}{d^2p}, \text{sin } \gamma \text{ and cos } \gamma \text{ are}$$

in $\gamma$ and cos $\gamma$ are deduced from the following formulas:

$$\sin\gamma = \frac{1}{\sqrt{1 + \frac{d^2p}{v^2(2d+p)}}}; \cos\gamma = \frac{1}{\sqrt{1 + \frac{v^2(2d+p)}{d^2p}}}$$

which are introduced in the formulas leading to the calculation of 1 from the polar equations of the parabola and of the ellipse related to the focus F.

$$\rho_1 = \frac{P}{1+\cos\gamma} = \frac{v+2p}{1+\cos\gamma} \quad \text{(parabola } P_1\text{)}$$

(1)

$$\rho_1 = \frac{(P_1+2)^2 - (FF')^2}{2\left(P_1 + 2 - (FF')\cos\left(\frac{\pi}{2} - \gamma\right)\right)} = \frac{(P_1 - P_2)^2 - (v+p)}{2(P_1 + P_2 - (v+p) \text{ sin}}$$

or:

$$P_1 + P_2 = F'L + l = Ct \quad (\textit{ellipse } \epsilon)$$

or:

$$(F'L) = \sqrt{l^2 + (v+p)^2} \text{ and } P_1 + P_2 = l + \sqrt{l^2 + (v+p)^2}$$

by substitution p and P can be calculated. The parabolas $P_1$, $P_2$ and the ellipse are drawn through standard geometrical methods.

The assembly can practically be achieved through a standard embossing process according to which each component is nested into the other and positioned by means of a tongue and groove.

Figure 1B:
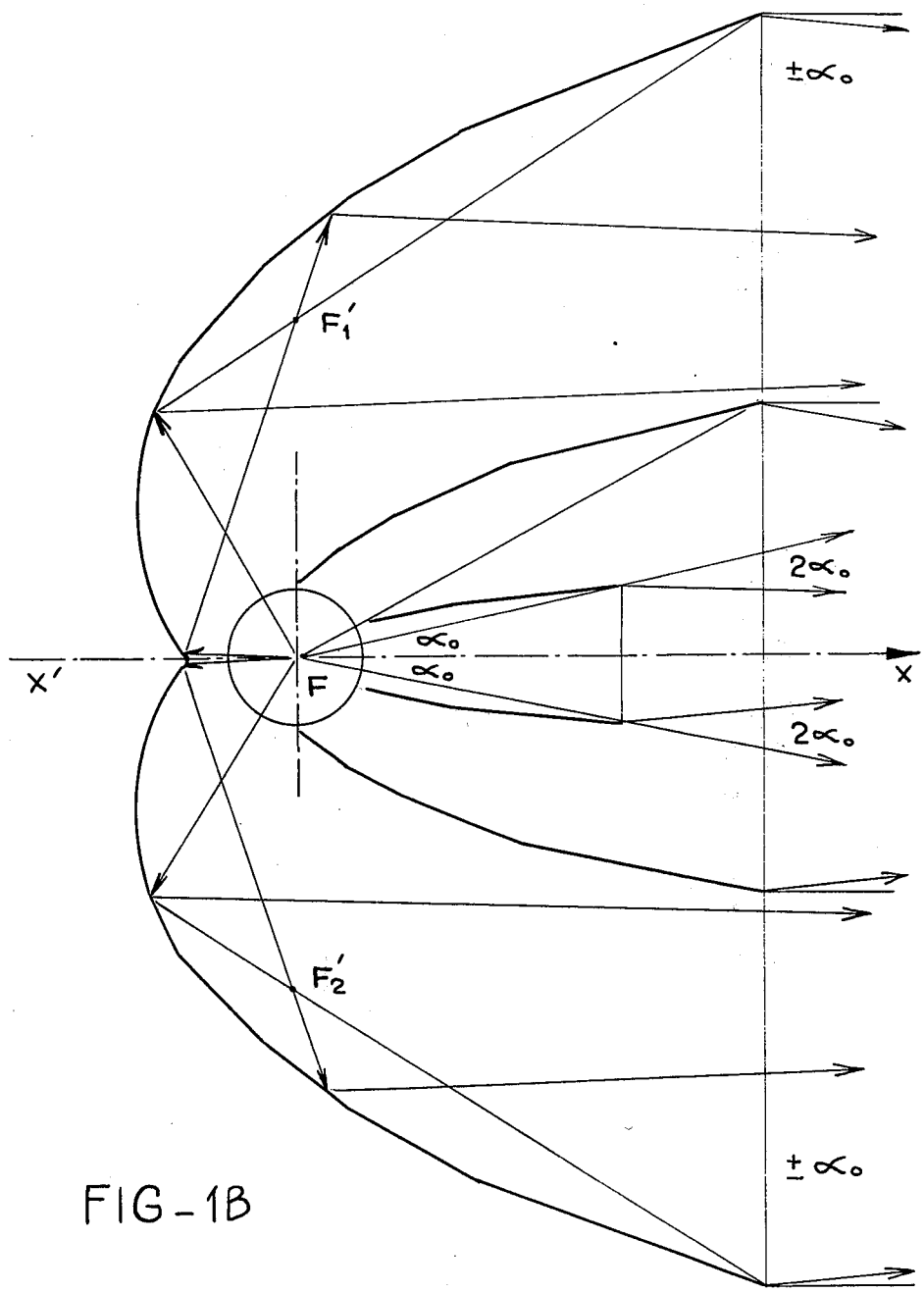
FIG. 1B is a cross-section view of an alternate optical device including four auxiliary reflectors.

In order to obtain better optical efficiency, polished aluminum may be used. Finally, to improve the homogeneity and increase the diffusion and opening of the beam, it is advisable to replace the parabolic curve lines by broken lines (FIG. 1B).

Thus, in order to obtain a more divergent (extensive) beam, it is sufficient to reduce the number of small faces, to truncate the auxiliary reflectors or to remove one, depending on extension sought.

To obtain a better focusing, it is preferable to position the lamp by means of a fixed centering, and to maintain it by a system of clips which will be integral with the optic and not with the protecting case.

For certain applications, it is advisable to make the beam asymmetric by removing one or more semi-reflectors.

Finally, the shape of the optic in relation to its axis can be revolution or rectangular, depending on its use with light sources having a homogeneous shape, or a linear one. When a point source is involved, the device will be a revolution device, the axis of revolution passing through the source being the axis of symmetry of the directrix curve. When a linear source is involved, the device will be cylinder-shaped, the generatrixes of the cylinder being parallel to the source. In that last case, the lateral closing is performed by two inclined reflector components the nature of which is the same as that of the main reflector.

Figure 4:
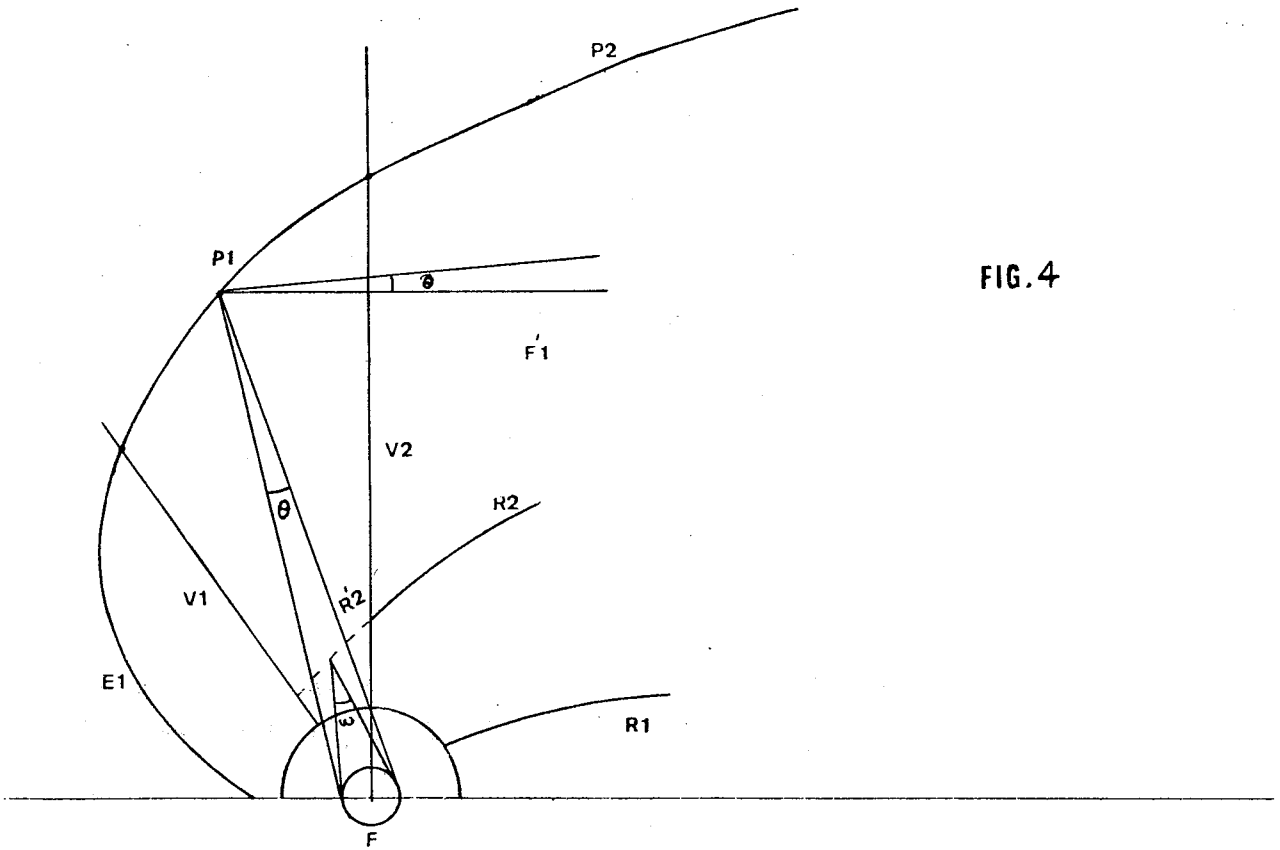
FIG. 4 is a diagrammatical view of two different paths followed by the beams.

As shown in FIG. 4, the curve is formed by an arc of ellipse $E_1$ one focus of which coincides with the non-point source F. The other focus $F'_1$ also constitutes the focus of the curve $P_2$, a parabola. The junction between the curves $E_1$ and $P_2$ is ensured by a segment of curve $P_1$ which may be either a parabola or an ellipse.

Finally, two curves $R_1$ and $R_2$ with conic lines one focus of which coincides with the luminous source F are provided at the front portion.

Also, in said FIG. 4, the radius vectors $V_1$ and $V_2$ which connect the center of the luminous source F to the common ends of the curves $E_1$, $P_1$ and $P_2$ are shown.

The curve $R_2$ may either stop at the radius vector $V_2$ or include an extension $R'_2$ which is located in the arc formed between the radius rectors $V_2$ and $V_1$.

If the extension $R'_2$ is used, the curve $P_1$ is useless because all the luminous beams falling onto the extension $R'_2$ are reflected forward.

On the other hand, if there is no extension $R'_2$, it is of interest to provide a curve $P_1$ one focus of which corresponds to the rear source F.

By way of comparison, if we consider the beams issued from a point W of the extension $R'_2$ and a point Q of the curve $P_1$, and which corresponds to the source F, we can see that the angle $\omega$ under which the rear source F is shown from the point W is greater than the angle $\theta$ under which the point Q sees the real source F. As a result, the angle $\omega$ of the beam issued from the point W is greater than the angle $\theta$ issued from the point Q.

Under these conditions, when the luminous source F is of a certain size, it is of advantage to remove the extension $R'_2$ from the curve $R_2$ so as to replace this reflecting surface by the curve $P_1$.

Figure 5:
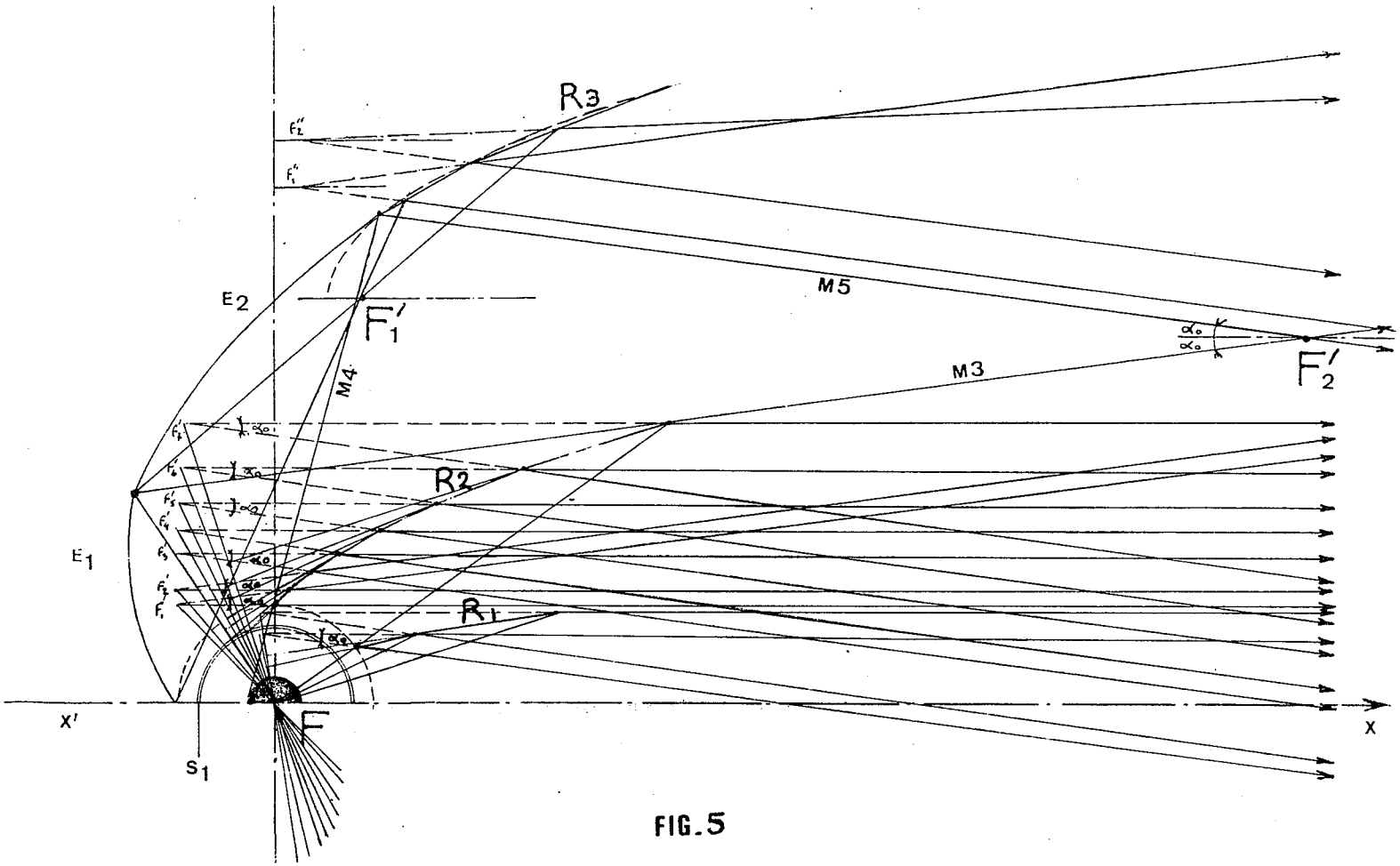
FIG. 5 is a general diagram of an optical device some curves at least of which consist of small faces.

As shown in FIG. 5, the reflecting surface of the optical device consists of two curves $R_1$, $R_2$ which are arcs of parabolas, whose axis is parallel to the axis X-X' of the beam and the focus of which corresponds to the geometrical center F of the source. However, said source if a rear source and comprises an envelope $S_1$ shown in the Figure.

The curve originating the reflecting surface also comprises a curve consisting of the arcs of curves $E_1$, $E_2$ and $R_3$, which reflect forward the luminous beams issued to the rear by the source F.

The curve $E_1$ is an ellipse the focus of which coincides with the geometrical center of the luminous source F and the other focus $F'_2$ of which coincides with the focus of the curve $R_3$ which is a parabola.

Finally, the curve $E_2$ is a curve connecting the curves $E_1$ and $R_3$ together. Said curve $E_2$ is, for example, a parabola whose focus coincides with the geometrical center F of the real luminous source.

As diagrammatically shown in FIG. 5, said curve $E_2$ can also be an ellipse one focus of which coincides with the center F of the luminous source and whose other focus $F'_2$ is located at the front portion of the optical device.

As shown in FIG. 5, the various curves $R_1$, $R_2$ and $R_3$ have been replaced by segments of straight line corresponding in shape to said curves, so as to simplify production. The drawing of said curves with their chord, their tangent or an intermediate segment will be described with reference to FIGS. 6A, 6C hereafter.

Figure 6A:
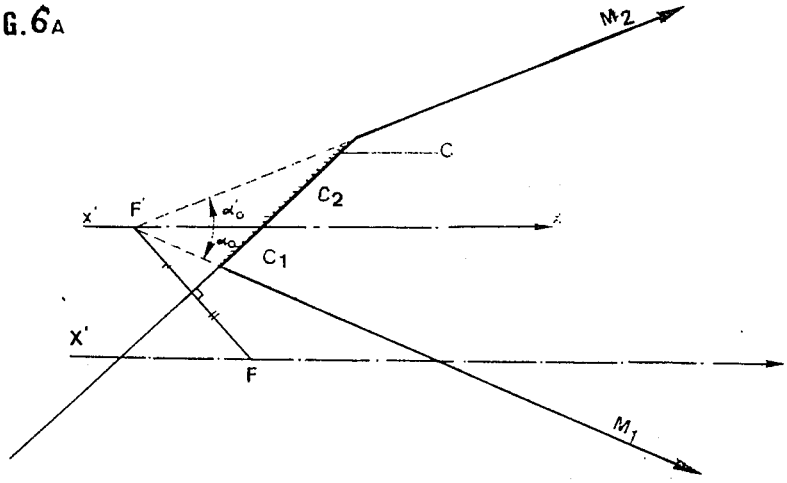
FIG. 6A, 6B and 6C are three explanatory diagrams showing the geometrical construction of the small faces.
Figure 6B:
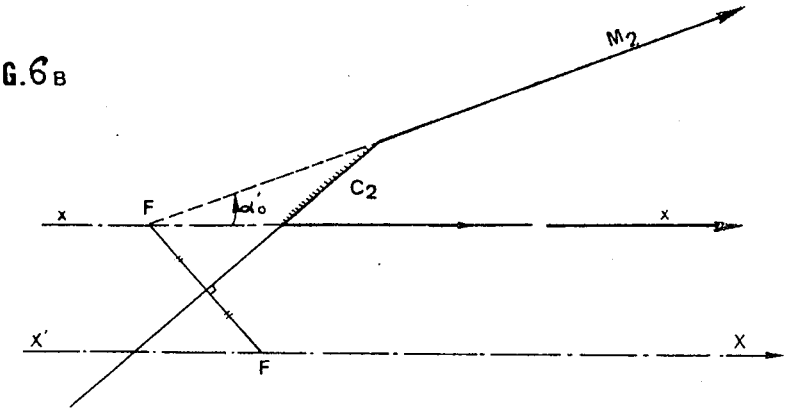
Figure 6C:
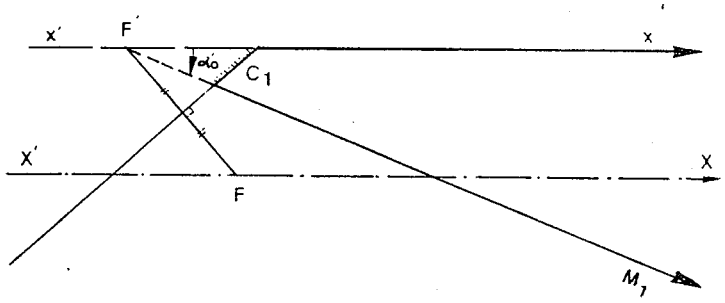

The geometry explanations given with reference to FIGS. 6A, 6B and 6C apply to the three types of curves likely to be contemplated, according to the invention, namely, the ellipses, the parabolas or hyperbolas.

As shown in FIG. 6A, an arc of a curve whose focus is F is replaced by a chord C constituting a reflecting surface. Under these conditions, according to the characteristics of plane mirrors, the beam issued from the source F located at the focus of the curve seems to be issued by the virtual source F', which is symmetric in relation to C. Said virtual source F' issues a beam comprised between two limit radii $M_1$, $M_2$ passing by the ends of the small face C, according to an angle $\alpha_0 + \alpha'_0$. Both angles are respectively considered from the axis $x$-$x'$ parallel to the optical axis X-X'.

It thus can be seen that in fact the beam issued consists of two beams, namely, the beam of the angle $\alpha_0$ limited by the radius vector $M_1$ and axis $x$-$x'$ and on the other hand, the beam of the angle$\alpha'_0$ limited by the radius vector $M_2$ and axis $x$-$x'$.

Thereby, the chord C can be divided into two parts: the part $C_1$ corresponding to the angle $\alpha_0$ and the part $C_2$ corresponding to the angle $\alpha'_0$.

FIG. 6B shows the case of a small face consisting only of the part $C_2$, whilst FIG. 6C shows the case of a small face only consisting of the part $C_1$.

Both FIGS. 6B and 6C show that if a curve consists of chords or tangents, it will produce a divergent beam, either upwards (FIG. 6B), or downwards (FIG. 6C).

Depending on whether the curve originating the reflecting surface is located above the axis X'-X or beneath the latter, one of the two solutions will be selected so as to prevent the beam from being dispersed and limit its opening to the angle $X\alpha_0$ or $\alpha'_0$ selected and not to the addition $(\alpha_0 + \alpha'_0)$.

FIG. 5 shows geometrical constructions with the curves $R_1$ and $R_2$ being parabolas. As regards the curve $R_2$, the virtual pictures $F'_1 \ldots F'_6$ of the geometric center F of the luminous source have been shown.

When the curves $R_1$ and $R_2$ are ellipses, the construction approached by small faces is similar to what is described hereabove. However, it will thus be possible to get smaller surfaces $R_1$, $R_2$, which reduces the whole of the optical device.

Also, this Figure shows that the curve $E_1$ is included within the radius vectors $M_3$ and $M_5$. The radius vector $M_3$ is the beam issued from the luminous source F and reflected at the upper end of the curve $E_1$. The radius vector $M_5$ is reflected from the radius vector passing close to the end of the curve $R_2$, the closest to the luminous source. A radius vector $M_4$ issued at the periphery of the read source passes close to the end of the curve $R_2$ closest the source F.

Finally, as shown by FIG. 5 at the focus $F'_2$, the inclination of the small faces corresponding in shape to a parabola, an ellipse or a hyperbola, in each case, are selected so that the angles $\alpha_0$ and $\alpha'_0$ are equal, in order to prevent a greater dispersion in either direction.

Under these conditions, generally the small faces of the curve correspond to intermediate segments of a straight line between a chord and a tangent.

Figure 7:
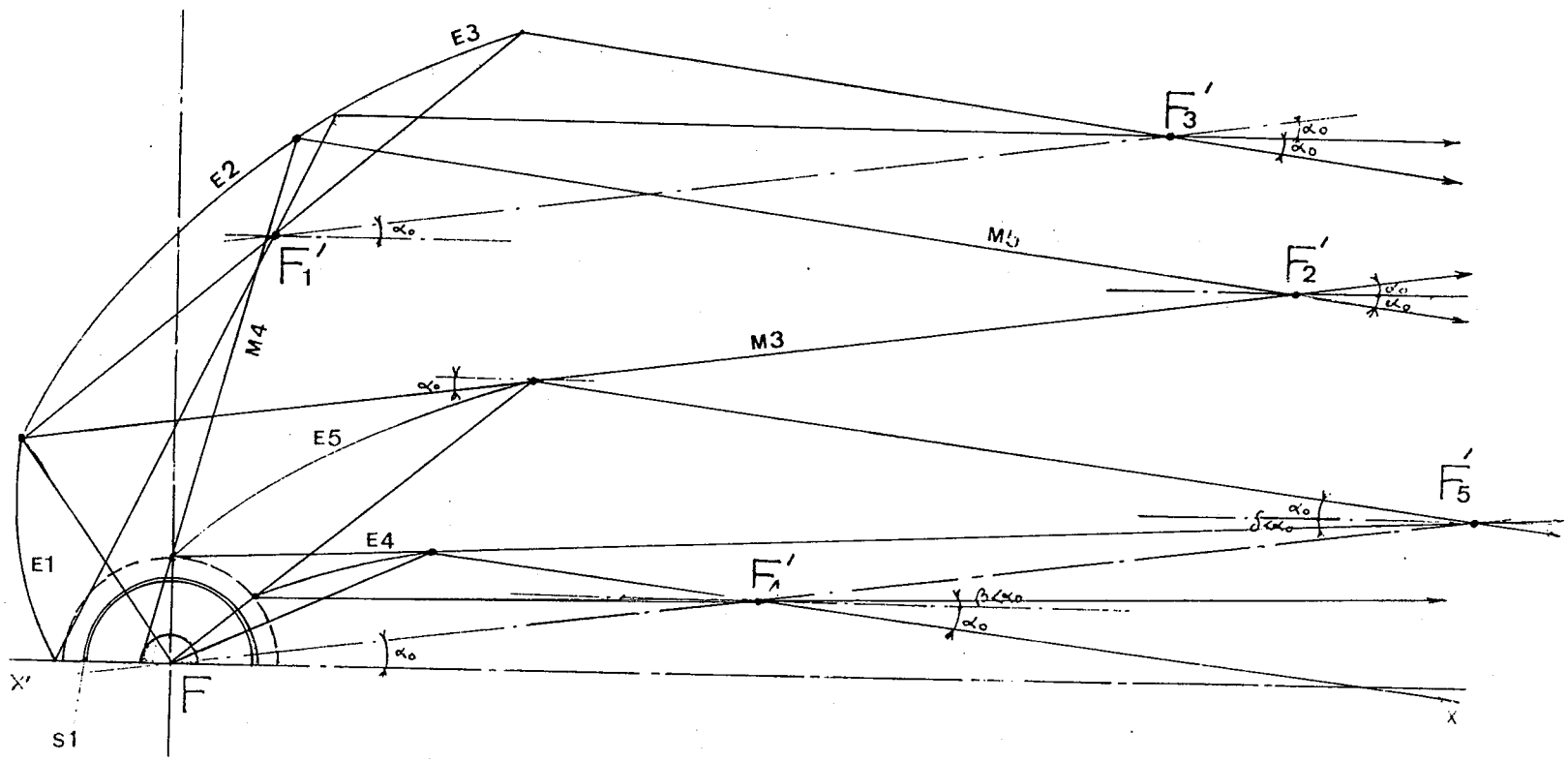
FIG. 7 is an alternate embodiment of an optical device according to the present invention.

FIG. 7 shows an optical device according to the invention, consisting of segments of ellipses.

The rear portion of the device consists of three arcs of ellipse $E_1$, $E_2$, $E_3$. The arc of ellipse $E_1$ is the same as in FIG. 1. The focus F of said ellipse $E_1$ corresponds to the geometrical center of the rear source F whose envelope is $S_1$ and the second focus thereof $F'_1$. As formerly, the second focus $F'_2$ of the ellipse $E_2$ whose first one is at F, is selected at the intersection of the radius vector $M_3$ with a radius vector $M_5$ symmetric with the preceding one in relation to the axis X-X' of the optical device. It being understood that the beam $M_5$ is the beam reflected by the upper end of the arc $E_2$ from the beam $M_4$, which is the beam passing close to a curve $E_4$ from the real source F, directly onto the ellipse $E_2$.

Finally, the ellipse $E_3$ has a first focus coinciding with the second focus $F'_1$ of the ellipse $F'_2$, so that the beam thus issued is included within two limit radii forming the angle $\alpha_0$ in relation to the axis X-X'.

It can be seen that, so as to avoid any heterogeneity and the absence of luminous beams in the direction X-X', the axis $F'_1$, $F'_3$ of the curve $E_3$ must make an angle substantially equal to $\alpha_0$ in relation to the axis X-X'.

Also, the curves limiting the opening of curves $E_4$, $E_5$ before the curves $E_1$, $E_2$, $E_3$, consist of curves similar to ellipses the first focuses of which coincide with the geometrical center of the real source F. The second focuses of both curves $E_4$, $E_5$ are selected in front of the optical device so as to obtain a beam whose opening is at the maximum to the angle $\alpha'_0$ from each part of the horizontal. Thus, both focuses $F'_4$ and $F'_5$ are obtained. In both cases, the curves are selected in such a way that the angle $\alpha'_0$ referenced as per FIGS. 6A . . . 6C and $\beta$ and $\delta$ in FIG. 7 is smaller than $\alpha_0$.

As with $E_3$, it is advantageous that the axis of the curves $E_4$, $E_5$ makes an angle of about $\alpha_0$ with the axis X-X'.

According to a simple variation of the invention, the curves $R_1$, $R_2$, $R_3$, etc. . . . , are geometrically achieved through a point to point construction by starting from a firt segment as shown in FIGS. 6A, 6B, or 6C to which the consecutive segment is joined, by always respecting the angle of orientation selected. Thus, said construction is continuously repeated.

Practically, curves consisting of segments of straight lines are especially interesting, because these may be formed by folding of sheet-iron. This avoids a long and onerous manufacture, with continuous variations of the radii of curvature, in order to obtain an arc of parabola, ellipse or hyperbola.

As shown in FIGS. 5 and 7, a certain distance has been provided for all purposes between the envelope $S_1$ of the real source F and the nearest point of the corresponding reflecting surfaces, so as to make it possible to mount the luminous source and prevent the reflecting surfaces from being in contact with the envelope $S_1$.

Figure 8:
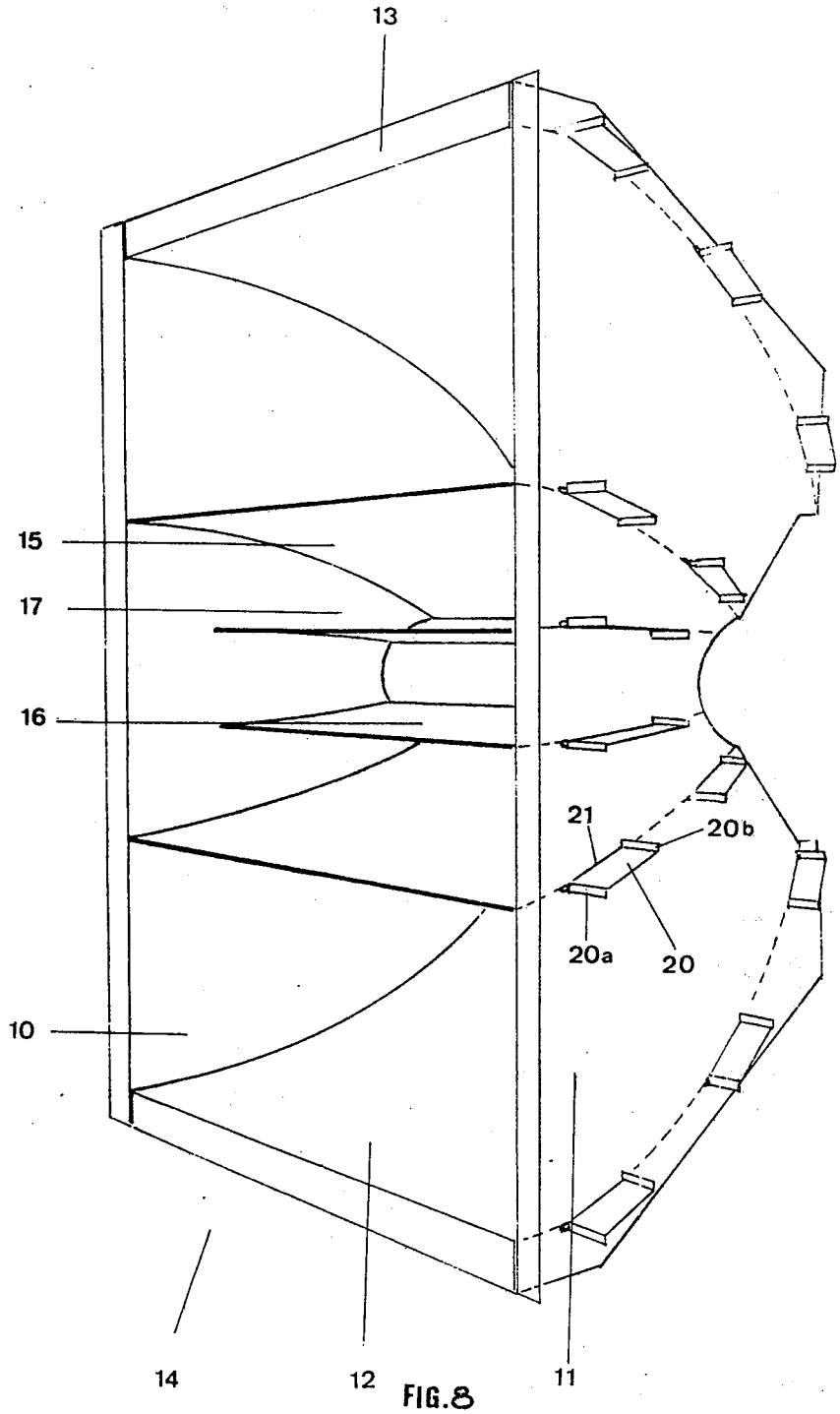
FIG. 8 is a perspective view of the reflecting surfaces of an optical device.

FIG. 8 is a perspective view of a practical embodiment of an optical device according to the invention. Said FIG. 8 shows a device symmetric in relation to a horizontal plane. This device consists of lateral walls 10 and 11, slightly brought toward each other at the rear portion of the device, as well as reflecting surfaces 12, 13, 14, 15, 16, 17. Said reflecting surfaces 12 . . . 17 consist of sheet metal provided at their end with tongues 20 passing through the apertures 21 made in the lateral walls or flanges 11, 12. After introduction of said tongues 20 into the apertures 21, the ends 20a, 20b are turned down so as to clamp mounting.

Said mounting is identical for all the reflecting surfaces 12 . . . 17.

Such a mounting is particularly simple, because it does not require any riveting or welding which would result in the assembly and, thereby, create deviations of the luminous beams.

In FIGS. 5 and 7, half upper portions of the optical device according to the invention are shown. Obviously, the half lower portions of these optical devices can be symmetric in relation to the upper or different halve portions of the latter. Any combinations, either in view of the geometrical parameters or of the curves, parabolas, hyperbolas, ellipses thus used, can be contemplated depending on the application of the optical devices.

Thus, it is quite possible to remove for example from the lower portion the reflectors $R_1$, $R_2$, $R_3$, in combination or separately, the curve $E_2$being in such a case an ellipse, a parabola, etc.

Of course, the invention is not limited to the modes of embodiment described and represented hereabove, from which other modes and forms of embodiment can be provided without thereby departing from the scope of the invention.

I claim:

1. An optical device for a luminous source for producing a beam of light having an axis, said device comprising first, second and third reflecting surfaces, said first surface being described by an arc of an ellipse having a first focus coincident with said luminous source and a second focus, said second reflecting surface being described by an arc of a parabola having an axis parallel to the axis of the beam of light, the focus of said parabola being coincident with said second focus of said ellipse and said third reflecting surface described by an arc of a curve of second degree positioned between said second reflecting surface and said axis, the focus of said third surface coincident with said source.

2. The device according to claim 1 wherein the arc of an ellipse and the arc of a parabola have their concavities directed toward said beam axis.

3. A device according to claim 1 additionally including a fourth reflecting surface described by an arc of a curve of second degree positioned between the third reflecting surface and said beam axis, the focus of said fourth surface coincident with said source.

4. A device according to claim 1 wherein said curve of second degree is a parabola.

5. A reflector according to claim 3 wherein the fourth reflecting surface is described by an arc of a parabola.

6. A device according to claim 1 wherein said curve of second degree is a hyperbola having a focus positioned behind the reflector.

7. A device according to claim 1 wherein said curve of second degree is an ellipse having a focus positioned in front of the reflector.

8. An optical device for a luminous source for producing a beam of light having an axis, said device comprising first and second reflecting surfaces, said first surface being described by an arc of an ellipse having a first focus coincident with said luminous source and a second focus, said second reflecting surface being described by an arc of a parabola having an axis parallel to the axis of the beam of light, the focus of said parabola being coincident with said second focus of said ellipse and an intermediate reflecting surface described by an arc of a parabola whose axis is parallel to the axis of the luminous beam, the focus of said intermediate reflecting surface coinciding with the luminous source, said intermediate surface extending between said first and said second surfaces to reflect the light issued from the source in the area between the first and second surfaces.

9. An optical device for a luminous source for producing a beam of light having an axis, said device comprising first and second reflecting surfaces, said first surface being described by an arc of an ellipse having a first focus coincident with said luminous source and a second focus, said second reflecting surface being described by an arc of a parabola having an axis parallel to the axis of the beam of light, the focus of said parabola being coincident with said second focus of said ellipse and an intermediate reflecting surface described by an arc of a curve of the second degree whose axis is parallel to the axis of the luminous beam, the focus of said intermediate reflecting surface coinciding with the luminous source, said intermediate surface extending between said first and said second surfaces to reflect the light issued from the source in the area between the first and second surfaces.

10. An optical device for a luminous source for producing a beam of light having an axis, said device comprising first and second reflecting surfaces, said first surface being described by an arc of an ellipse having a first focus coincident with said luminous source and a second focus, said second reflecting surface being described by an arc of a parabola having an axis parallel to the axis of the beam of light, the focus of said parabola being coincident with said second focus of said ellipse, said luminous source being a surface of revolution about the axis of the beam and said reflecting surfaces being a surface of revolution about said axis.

11. An optical device for a luminous source for producing a beam of light having an axis, said device comprising first and second reflecting surfaces, said first surface being described by an arc of an ellipse having a first focus coincident with said luminous source and a second focus, said second reflecting surface being described by an arc of a parabola having an axis parallel to the axis of the beam of light, the focus of said parabola being coincident with said second focus of said ellipse and a housing having plates constituting the reflecting surfaces provided with tongues positionable in corresponding apertures of the housing with said tongues being bent relative to said apertures for securing the plates in said housing.

* * * * *